US007245730B2

(12) United States Patent
Enzmann

(10) Patent No.: US 7,245,730 B2
(45) Date of Patent: Jul. 17, 2007

(54) AIDED EAR BUD

(75) Inventor: Mark Enzmann, Blairsville, GA (US)

(73) Assignee: Cingular Wireless II, LLC, Atlanta, GA (US)

( * ) Notice: Subject to any disclaimer, the term of this patent is extended or adjusted under 35 U.S.C. 154(b) by 532 days.

(21) Appl. No.: 10/341,293

(22) Filed: Jan. 13, 2003

(65) Prior Publication Data

US 2004/0136555 A1 Jul. 15, 2004

(51) Int. Cl.
*H04R 25/00* (2006.01)

(52) U.S. Cl. ..... 381/315; 381/312

(58) Field of Classification Search ..... 381/312–316; 379/55.1, 430

See application file for complete search history.

(56) References Cited

U.S. PATENT DOCUMENTS 5,835,610 A * 11/1998 Ishige et al. ..... 381/315
6,694,034 B2 * 2/2004 Julstrom et al. ..... 381/315
6,879,695 B2 * 4/2005 Maltan et al. ..... 381/315

* cited by examiner

*Primary Examiner*—Suhan Ni
(74) *Attorney, Agent, or Firm*—Coulter Henry; Parks Knowlton LLC; Paul E. Knowlton, Esq.

(57) ABSTRACT

An aided ear bud device is provided that operates as a hearing aid device as well as an ear bud device for a wireless phone. The aided ear bud normally operates as a hearing aid device. The aided ear bud state is changed by a verified input from a wireless phone. Upon the change in state, the microphone input from the aided ear bud is remotely output to the wireless phone while the incoming transmission from the wireless phone is combined with the microphone input and output to the user. The ear bud device can be modified to receive analog or digital inputs from other outside sources.

14 Claims, 8 Drawing Sheets

AIDED EAR BUD

BACKGROUND OF THE INVENTION

1. Field of Invention

This invention relates to systems and methods for providing a hearing aid capable of communicating with a wireless phone. More particularly, this invention provides a hearing aid capable of simultaneously or alternatively performing the functions of an ear bud for the wireless phone.

2. Description of Related Art

Hearing aid users commonly experience interference from the high-frequency electromagnetic signal emitted by wireless phones when the phone is placed in close proximity to the receiver/microphone of the hearing aid. The interference—manifested as a "buzz" or "hum" in the hearing aid—makes the use of wireless phone handsets difficult for the hearing-impaired device users. For example, a hearing aid device wearer is not able to effectively use a wireless phone by placing the handset in close proximity to hear a caller through the earpiece of the handset. Thus, the user is forced to endure the discomfort of the "hum", use an induction-type device (if wearing a t-coil type hearing aid), constantly adjust the hearing aid or not use a wireless phone at all.

Conventional attempts at solving this problem have had inherent problems that can make the use of those items undesirable. However, to this point, the hearing-impaired community hasn't had many choices. For example, personal loopsets were developed to apply the audio induction principle to t-coil type hearing aids. The coil of a loopset is worn around the user's neck. The coil is electromagnetically coupled to an emitter coil inside the hearing aid. The emitter coil receives a digital voice signal from the wireless phone, transmits the corresponding electromagnetic field to the coil, and ultimately to a hearing aid placed in proximity to the coil.

The current induction loopset designs have inherent problems associated with them: that make them cumbersome and difficult to use. The hearing-impaired user is almost forced to constantly wear the loopset to hear an incoming call to the wireless phone. However, if a user decides to keep the loopset in a pocket or a bag a user must fumble to put the loopset on if a call is received while the loopset is not being worn.

Co-pending, co-owned application Ser. No. 10/328,388 to Shively et al., has taken a different approach and addressed the interference issue by redirecting and relocating signal transmissions from the antenna of the handset away from the hearing aid. In the systems discussed in the Shively patent, a waveguide device is placed over the antenna. The waves transmitted from the antenna are captured by the waveguide and retransmitted at a remote antenna located on a user's belt loop, etc.

Ear bud devices have been developed to enhance the portability of a wireless phone. The ear bud device is a type of hands free device and is essentially a headphone-type device communicates with an attached wireless phone so that a user has use of their hands and attention for other tasks, such as driving, writing, etc. Current ear bud devices must be placed in or in close proximity to the ear, meaning that the ear bud placement conflicts with the placement of the hearing aid. Thus, hearing impaired users have a difficult time using ear buds.

Thus, the inventor has discerned that there is a need to address the above-mentioned problems by providing a hearing device that functions both as a hearing aid and as a wireless phone ear bud.

SUMMARY OF THE INVENTION

As outlined above, conventional attempts at providing a practical way of allowing a hearing-impaired user to use a wireless phone has inherent shortcomings that cannot be overcome due to their configurations. Thus, it is an object of the present invention to provide a different approach that would cause removal of the above-mentioned inherent problems. This approach provides a method of adapting a hearing aid to be more user-friendly to the hearing-impaired wireless phone user.

Therefore, this invention provides systems and methods for adapting a hearing aid to operate as an ear bud device in addition to providing conventional hearing aid functions. Using this method, this invention is able to address many of the issues hearing impaired wireless phone users encounter while addressing the inherent problems associated with the conventional solutions.

This invention also provides systems and methods for providing multiple input signals into the hearing aid.

This invention provides systems and methods for monitoring a noise signal entering the hearing device and deciding upon the state of the hearing device based on the incoming signal.

This invention provides systems and methods for switching between the hearing aid functions and the ear bud functions based on an incoming signal from a valid wireless phone.

In the various exemplary embodiments according to this invention, the ear bud device monitors the noise being received by its microphone and a transmit/receive unit. Once the transmit/receive unit accepts an input that is anything but ambient noise, the system determines if the input is coming from a valid source. The validity of the source is based on a preprogrammed indicator. Based on this determination the ear bud device will switch to the appropriate mode of operation.

In the various exemplary embodiments according to this invention, a switch controlling the mode of operation is also activated and switched based on commands from the source that has been determined to be valid.

These and other features and advantages of this invention are described in or apparent from the following detailed description of the apparatus/systems and methods according to this invention.

BRIEF DESCRIPTION OF THE DRAWINGS

Various exemplary embodiments of this invention will be described in detail, wherein like reference numerals refer to identical or similar components or steps, with reference to the following figures, wherein.

DETAILED DESCRIPTION OF EXEMPLARY EMBODIMENTS

The exemplary embodiments of the systems and methods according to this invention provide a method for adapting a hearing aid so that the hearing aid is able to function as an ear bud device i.e., an aided ear bud. The exemplary embodiments also provide a system that interprets incoming signals to determine in which operating mode the aided ear bud should operate. In the exemplary embodiments, the incoming signal can be digital or analog depending on the transmitting source.

Figure 1:
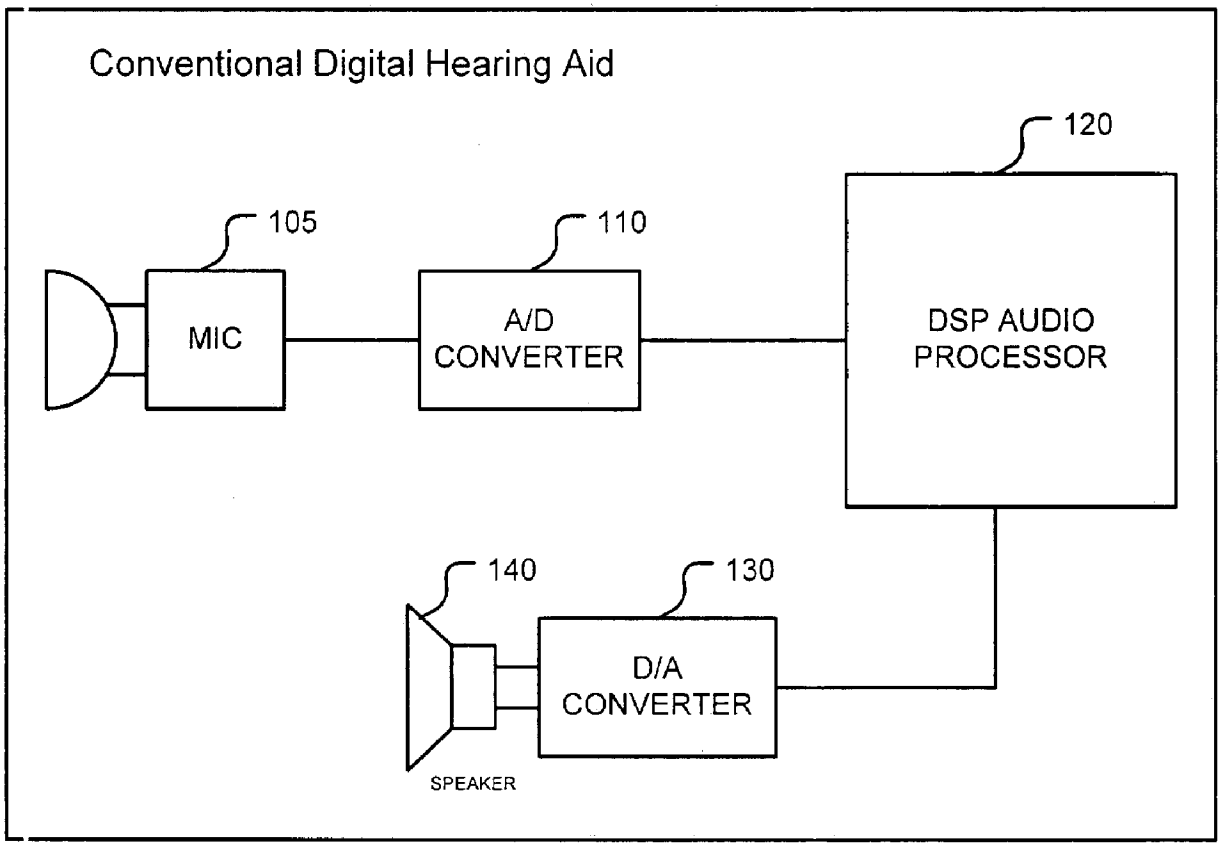
FIG. 1 PRIOR ART
FIG. 1 illustrates a conventional digital hearing aid.

FIG. 1 illustrates a conventional digital hearing aid. The conventional hearing aid comprises a microphone 105, an A/D converter 110, a digital signal audio processor (DSP) 120, a D/A converter 130 and a speaker 140. In operation, sounds, represented by an analog signal and/or ambient noise emitted from an outside source, is captured by the microphone 105 and converted to a digital signal by the A/D converter 110. The DSP 120 manipulates the converted signal in accordance with well-known techniques and sends a processed signal to the D/A converter 130. In the D/A converter 130, the processed signal is converted to an analog signal and output to the speaker 140. The speaker 140 is placed in or around the hearing impaired user's ear. Thus, the captured sounds have been captured, processed, and amplified and output to the user.

The manipulating processes of the DSP 120 serves both to amplify the converted signal from the A/D converter 110 and correct any degraded signal areas so that an improved signal is sent to the speaker 140. The manipulation processes may also adjust the incoming signal based on a preprogrammed frequency mapping of the user's hearing characteristics.

As known in the art, the signal processing functions of the conventional digital hearing aid, may be disrupted when a wireless phone is placed in close proximity due to either normal or spurious transmissions from the antenna of the phone.

The embodiments of the present invention allow the user to hear the audio transmissions of the wireless phone in the speaker of the aided ear bud. This is achieved by transmitting the audio output to the aided ear bud. Using this approach, the interruption due to feedback from the antenna of the wireless phone is eliminated because the wireless phone can be placed considerable distances away from the hearing aid such that the spurious transmissions from the antenna do not interfere with the processing functions of the aided ear bud. In addition, the portability of the wireless phone is increased because the user's hearing device can now act as a wireless ear bud for the wireless phone.

Figure 2:
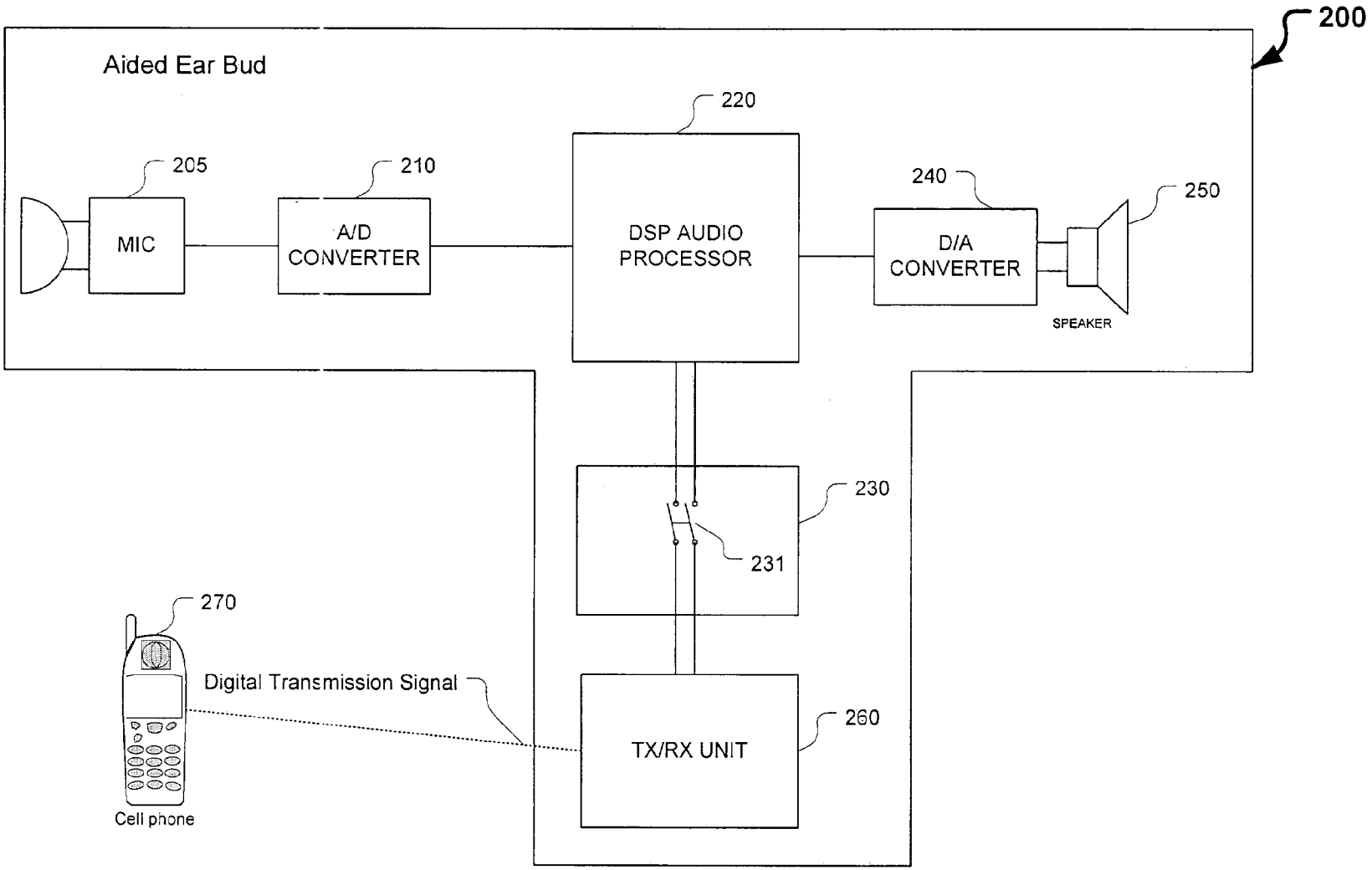
FIG. 2 illustrates the preferred embodiment of the aided ear bud according to the present invention.

FIG. 2 illustrates the preferred embodiment of the aided ear bud 200, according to this invention. As seen in FIG. 2, the aided ear bud 200 contains many of the same features of the conventional hearing aid shown in FIG. 1. The aided ear bud 200 comprises a microphone 205, an A/D converter 210, a digital signal audio processor (DSP) 220, a D/A converter 240 and a speaker 250. However, in addition to those items, the aided ear bud adds a source control module 230 and a transmit/receive (TX/RX) unit 260 to provide the necessary functions of this invention.

Under normal operating conditions (i.e., no cellular telephone connected or active), the aided ear bud 200 functions as a conventional hearing aid, as discussed with respect to FIG. 1 that operates in a conventional hearing aid mode. When a valid switch command and subsequent transmissions are received from the wireless phone 270, the aided ear bud 200 enters a second operation mode. To initiate that switching process, a valid switching command is sent to the TX/RX unit 260 from the wireless phone 270. Once the switching command is verified at the TX/RX unit 260, the TX/RX then unit sends a switching command to the source control module 230, which in turn will cause the aided ear bud 200 to enter into a second operating mode.

In the second operating mode, the TX/RX unit 260 transmits and receives communications from the wireless phone 270. The source control module 230 functions as a double poled, two-position switch for the aided ear bud 200 to allow communications to pass from the wireless phone 270 to the DSP processor 220. This function is represented as the switch 231 in FIG. 2. The source control module 230 detects when a valid switching command has been received from the TX/RX unit 260 to switch to the second operating mode. Otherwise, the switching function of the source control module 230 does not allow communications to pass from the wireless phone because the switch operates as and open switch. Ambient noise and the user's voice are captures by the microphone 205 and processed and combined with signals from the TX/RX unit 260 in the DSP 220 for output through the D/A converter 246 and the speaker 250. Thus, in normal operation, the aided ear bud operates in. The normal (hearing aid) mode, and with a telephone signal, the aided ear bud 200 operates in the ear bud mode. For example, if it is determined that ambient noise or general analog noise is being received through the microphone 205 and there has not been a valid switching command received at the TX/RX unit 260, the aided ear bud 200 operates as a hearing aid. However, if it is determined that a signal coming from the wireless phone 270 is a valid switching signal, the aided ear bud 200 switches states by activating the double poled switch 231. This switching function of the source control module transitions the operation of the aided ear bud 200, as an ear bud device.

The connection shown between the TX/RX unit 260 and the wireless phone 270 is preferably a wireless digital connection, such as Bluetooth, etc. However, it should be appreciated that the connection between the TX/RX unit 260 and the wireless phone 270 can be any kind of wireless or wired connection, and may be digital or analog, infrared (IR) or transmitted radio frequencies (RF) without, departing from the scope of the invention.

Figure 3:
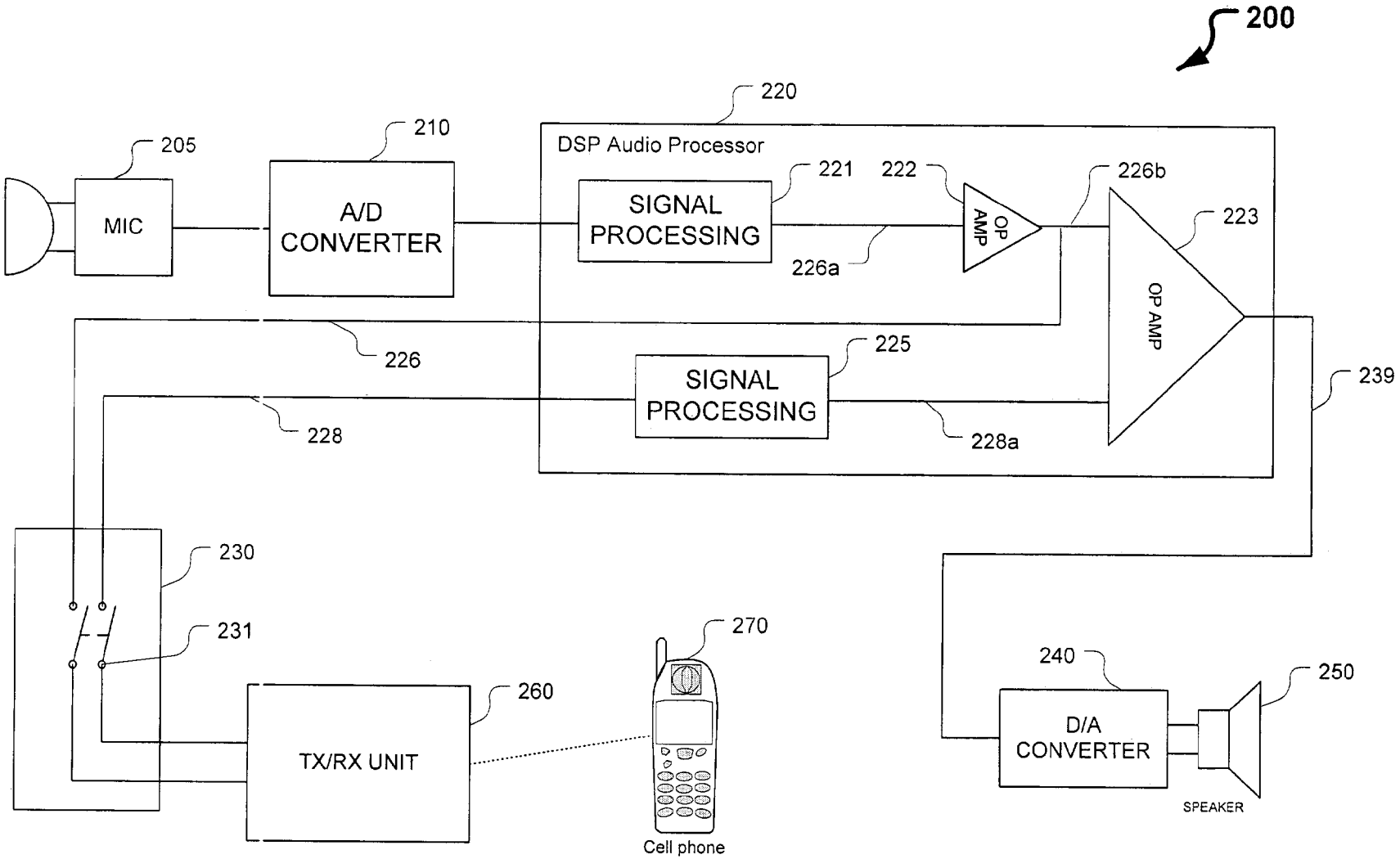
FIG. 3 illustrates an expanded view of the DSP Audio Processor according to the present invention.

FIG. 3 provides an expanded view of the DSP 220, according to the embodiments of this invention. As one can see from FIG. 3, the DSP 220 functionally includes two signal processing portions 221 and 225 and two op amps 222 and 223.

In the ear bud mode of operation, as mentioned above, the switch 231 is activated (i.e., closed), providing a continuous signal path for signals coming from the op amp 222 to be passed to the TX/RX unit 260 along signal line 226. Additionally, the TX/RX unit 260 can pass data to the op amp 223 along signal line 228 though the signal processing function 225 and signal line 228*a*.

Signals received at the microphone 205 are converted by the A/D converter 210, manipulated by the signal-processing function 221 which outputs 226*a* is then passed to the op amp 222. The output 226 and 226*b* of the op amp 222 are electronically connected to the TX/RX unit 260 and to the op amp 223. The output 226 connected to the TX/RX unit 260 is then output to the wireless phone 270. The signal from the TX/RX unit 260 is used by the wireless phone 270 as if the user was speaking into the microphone of the wireless phone.

Throughout the specification and drawings, the term "op amp" is used for illustrative purposes to provide an example of a device that could be used to combine the wireless phone and the microphone output signals, however, it should be appreciated that any device capable of combining two input signals to produce a mixed output signal can be used without departing from the scope of this invention.

The signals received at the microphone 205 are passed to the user as background noise and must be passed to the wireless phone 270 as if the user was speaking directly into the wireless phone 270. Remotely transmitting this signal to the wireless phone from the aided-ear bud 200 also allows the user to be located in a remote location away from the wireless phone 270.

The signal 226*b* passed to the op amp 223 is representative of ambient noise in the aided ear bud 200. This signal 226*b* is typically reduced in volume and combined with the input from the signal-processing function 225 to produce a mixed signal. The signal processing function 225 processes signal 228 from the TX/RX unit 260 and provides a second processing step so that the timing of the incoming signals from the microphone and the wireless phone are in sync and can be effectively combined to create a true representation of sound to the user. The op amp 223 outputs the mixed signal to the D/A converter 240, and finally to the speaker 250. The signal processing functions 221 and 225, to be implemented are known to those skilled in the art.

The signal 239, output to the speaker 250, is a combined signal based on inputs from the microphone 205 and the wireless phone 270. The combined signal is made to duplicate the experience of a non-hearing impaired person, in that the non-hearing impaired person hears a combination of his or her own voice and ambient noise when speaking into a wireless phone.

Figure 4:
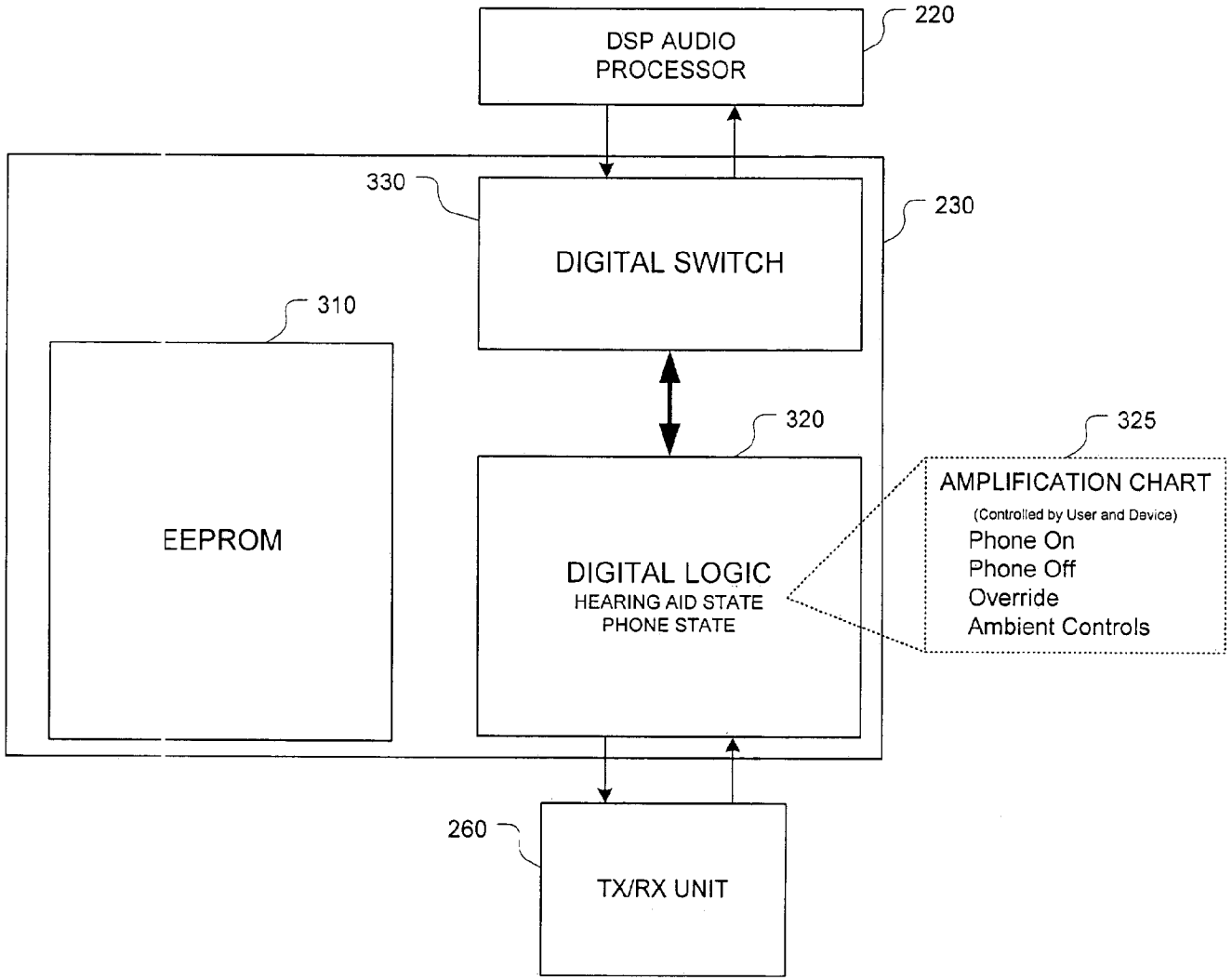
FIG. 4 illustrates an expanded view of a first embodiment of the source control module of the aided ear bud according to the present invention.

FIG. 4 provides an expanded view of the source control module 230 according to this invention. The source control module 230 preferably includes at least a digital switch 330, digital logic 320 and a memory device 310.

As shown in FIG. 4, the source control module 230 communicates with the DSP audio processor 220 and the TX/RX unit 260. The communications between these devices are in accord with the methods described above with respect to FIG. 3. The memory device 310 can be implemented using any appropriate combination of alterable, volatile or non-volatile memory or non-alterable or fixed memory. The alterable memory, whether volatile or non-volatile, can be implemented using any one or more of static or dynamic RAM, flash memory or the like. Similarly, the non-alterable or fixed memory can be implemented using any one or more of ROM, PROM, EPROM, EEPROM, or the like. However, in this instance, the memory device is illustrated as an EEPROM, which is the preferred device.

The digital switch 330 operates as a double pole, two-position switch. The digital switch 330 is controlled by an input from the digital logic 320. Upon receipt of a proper input from the digital logic 320, the activation state, and thus the position, of the digital switch 330 is changed. The activation state of the digital switch 330 is either opened (OFF) or closed (ON), the latter of which permits input signals to be sent to/from the digital logic 320 to the DSP Audio processor 220.

The digital logic 320 contains a series of devices consisting of multiple identical and separately identifiable structures built of some mix of combinational logic and sequential elements the sequential elements being commonly referred to as registers, latches, flip-flops, or shift register latches. These devices individually or in combination implement a series of activation states and wave patterns that determine the activation state of the aided ear bud and shapes of the frequency wave output from the digital logic 320. The functionality of the digital logic 320 is depicted in FIG. 4 as the amplification chart 325.

Figure 5:
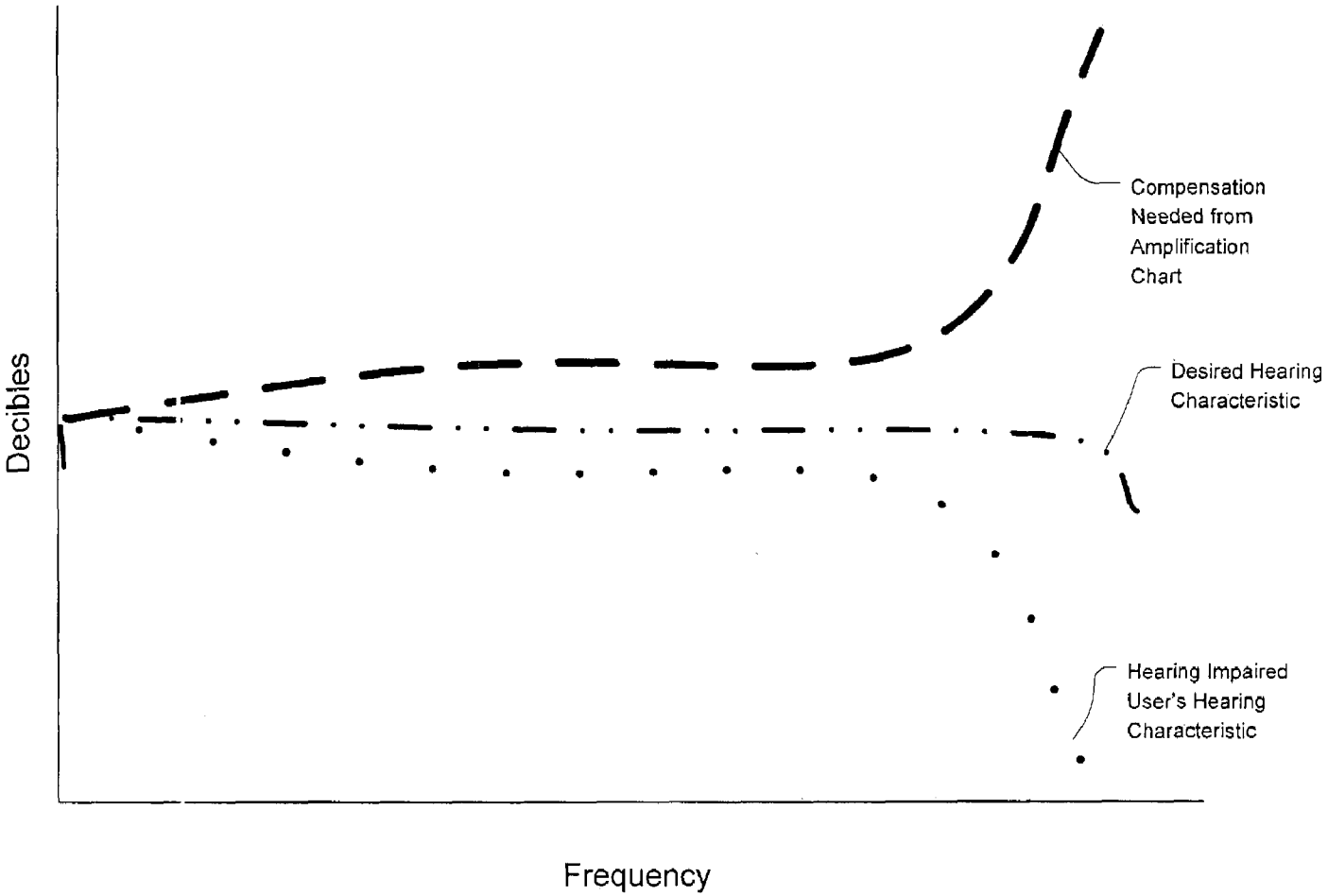
FIG. 5 illustrates an example of information contained in the amplification charts of the source control module.

The amplification chart 325 contains a series of pre-stored dynamic frequency maps based on the user's hearing characteristics, the speaker characteristics and the ambient noise near the aided ear bud 200. The digital logic 320 will receive the transmitted signal from the TX/RX unit 260 and process those signals to an optimal form based on the user's hearing, speaker and ambient noise characteristics. The arrangement of the logic devices within the digital logic 320 will serve to produce each of the characteristics (wave shape) of the amplitude chart 325. The user's hearing characteristics remain static unless the aided ear bud 200 is reprogrammed to compensate for additional hearing loss or increase and different users. For example, as shown in FIG. 5, a mapping of a user's hearing characteristic (denoted by the "••" line) illustrates that the user lacks significant hearing capability in higher frequencies. The desired hearing characteristic is denoted by the "-••" line. This desired hearing characteristic depicts or represents how a non-hearing impaired person's hearing characteristics may be. As known to those skilled in the art, close representation of this hearing characteristic is achievable by adding a complementary characteristic to the user's hearing characteristic to produce a result that is very close to the desired characteristic. Each of the characteristics is corrected using the process shown in FIG. 5.

The speaker characteristic is changed according to deterioration due to use of the speaker of the aided ear bud over time. The ambient noise characteristic is usually dynamic and updated as the noise levels around the ear bud change. The method employed in fixing the incoming sounds from the TX/RX unit 260 is similar to methods commonly known in the production of Fast Fourier transforms, which are well known the art at this time.

It should be appreciated that the characteristics represented in FIG. 5 are for illustrative purposes only. Each of the characteristics in FIG. 5 are device and user specific. Each of the characteristics can be set and calculated by information stored in the EEPROM 310.

Stored in the EEPROM 310 is an activation code that corresponds to a wireless phone that has been previously equipped for exclusive communication with each particular aided ear bud 200. It is preferable that each aided ear bud 200 id matched exclusively with a specific wireless phone 270. In operation, a validation code is transmitted by the wireless phone 270 to establish a communication channel between the wireless phone 270 and the aided ear bud 200. Once the validation code is received by the TX/RX unit 260, the transmitted validation code is compared to the activation code stored in the EEPROM 310. If the received validation code corresponds to the activation code in the EEPROM 310, a verification signal is sent to the digital switch 330 via the digital logic 320 to change its activation state to the aided ear bud mode to allow communications from the TX/RX unit 260 to freely pass to the DSP audio processor 220. Once the communication signal has ceased at the TX/RX unit 260, a deactivation code is sent to the digital switch 330 to cease communications passed from the TX/RX unit 260. Until the proper validation code has been received by the TX/RX unit 260, no communications can pass to the DSP audio processor 220 from the TX/RX unit 260. This permits the aided ear bud 200 to operate in the normal hearing aid mode while a telephone call is not in process.

An Overview of the Operation of the Aided Ear Bud

In operation, the aided ear bud initializes in the normal hearing aid mode. The ear bud operates in this mode until a validation code is received at the TX/RX unit 260. Once the proper validation code is received at the TX/RX unit 260, a signal is sent from the TX/RX unit 260 to the digital switch 330 to close and allow communications to pass. Once the digital switch is closed, signals from the TX/RX unit 260 are fixed by the digital logic 320 using the complementary characteristics, as discussed above, and passed to the DSP audio processor 220. The DSP audio processor 220 then fixes and combines a reduced representation of the input from the microphone and outputs the combined signal to the user's speaker. The reduced signal 226*b* is produced by decreasing the volume of the microphone signal such that the signal is small compared to the signal from the digital logic 320 when output to the user. The DSP audio processor 220 also outputs a second (truer) representation of the microphone signal to the wireless phone 270 such that the user can speak just as if they were speaking directly into the wireless phone 270. The user's voice would be captured by the microphone 205 and remotely output to the wireless phone 270.

Figure 6:
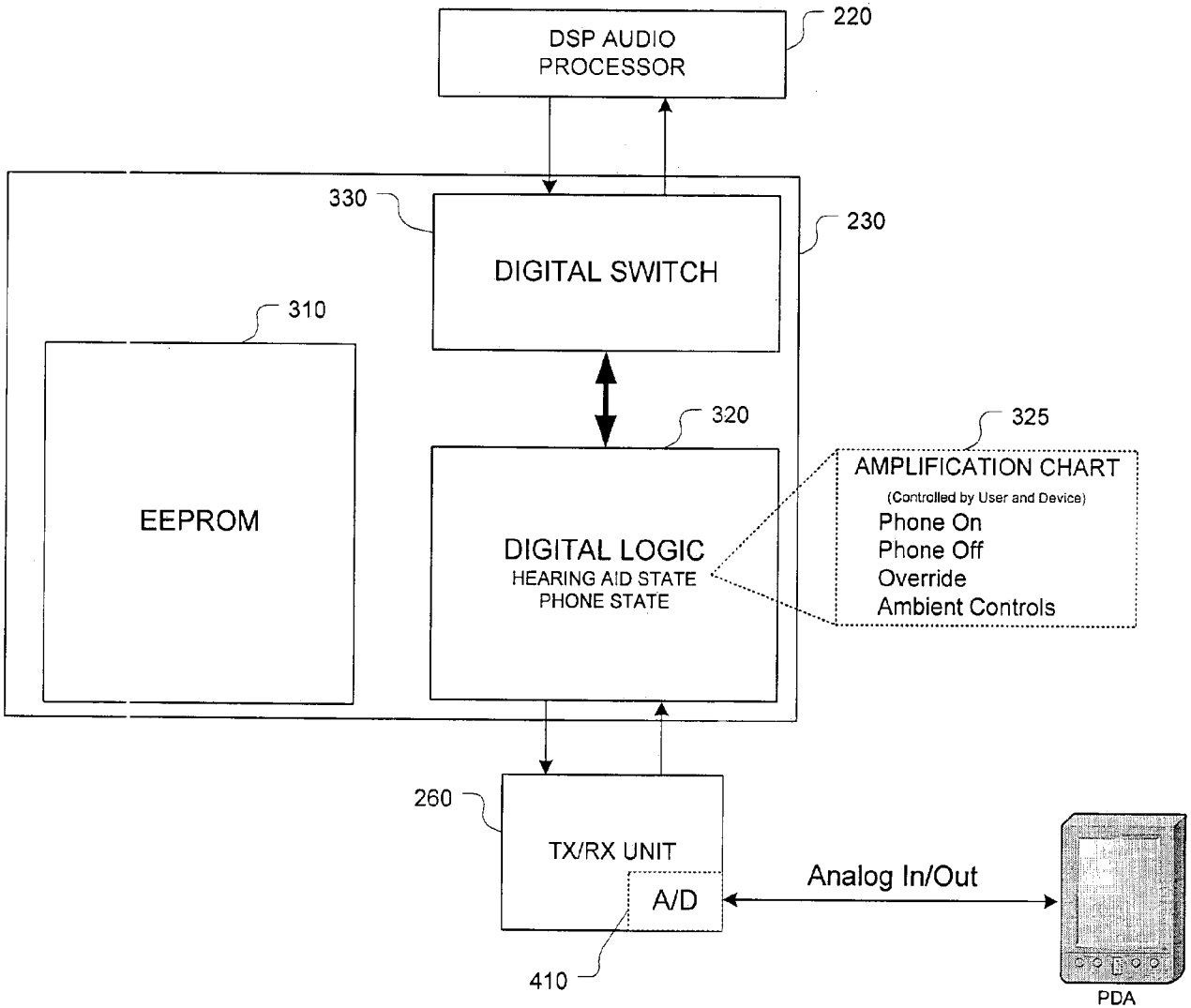
FIG. 6 illustrates an expanded view of a second embodiment of the source control module of the aided ear bud according to the present invention.

FIG. 6 illustrates a second embodiment of this invention, wherein analog devices can be attached to the aided ear bud. In this configuration, the A/D converter 410 converts incoming analog signals into a digital signal for use by the aided ear bud in accordance with the above-description and converts digital output signals to analog format and output to devices. This configuration allows a user to attach any analog device (or analog output from a digital device) to the aided ear bud, such as portable electronics (CD players, PDA devices) and any other devices that output analog signals. Otherwise, the operation of the second embodiment is similar to the previously described embodiment once the incoming signal is converted from an analog signal to a digital signal.

Figure 7:
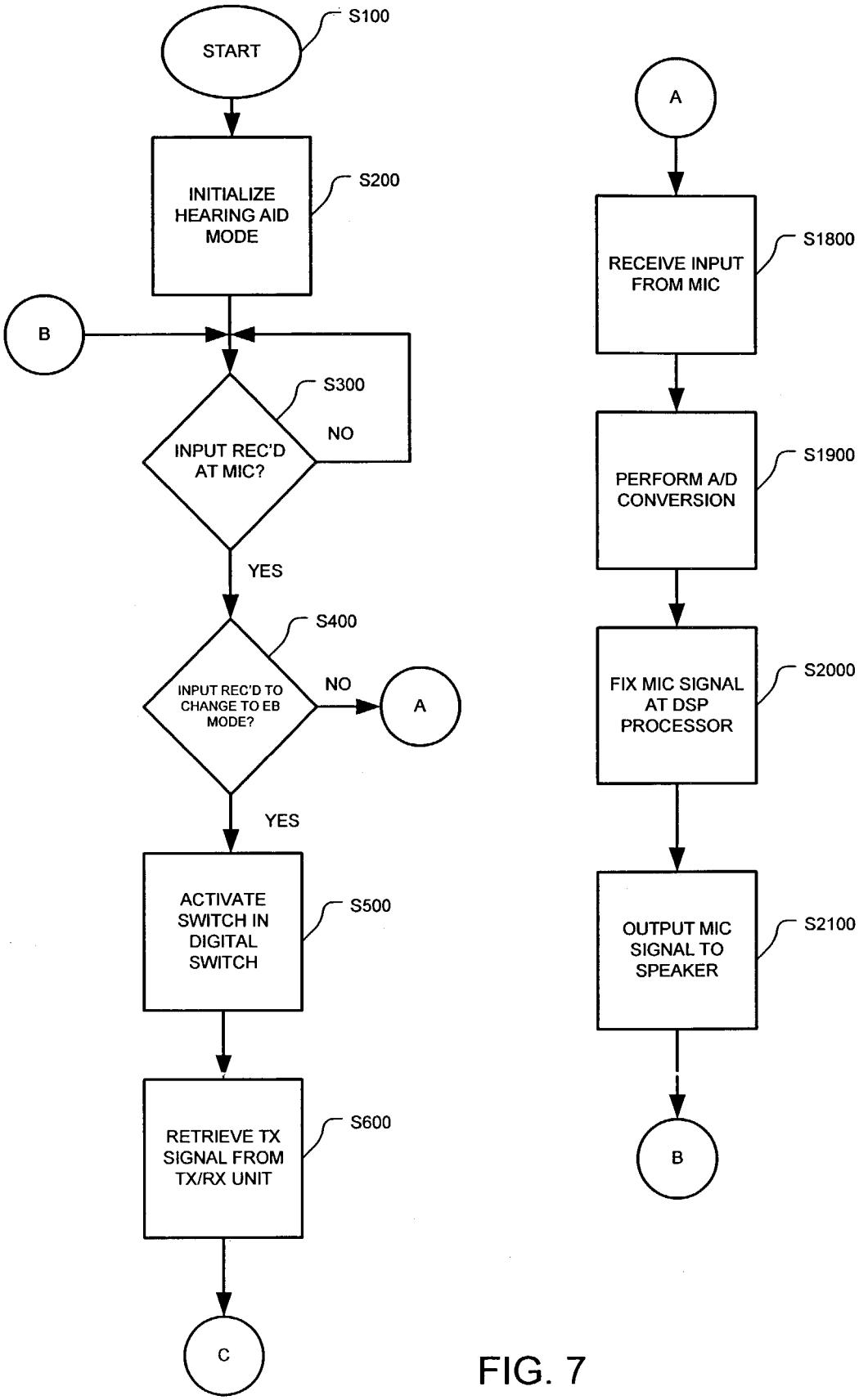
FIGS. 7 and 8 illustrate a flowchart outlining an exemplary method of receiving incoming calls using an aided ear bud according to the present invention.
Figure 8:
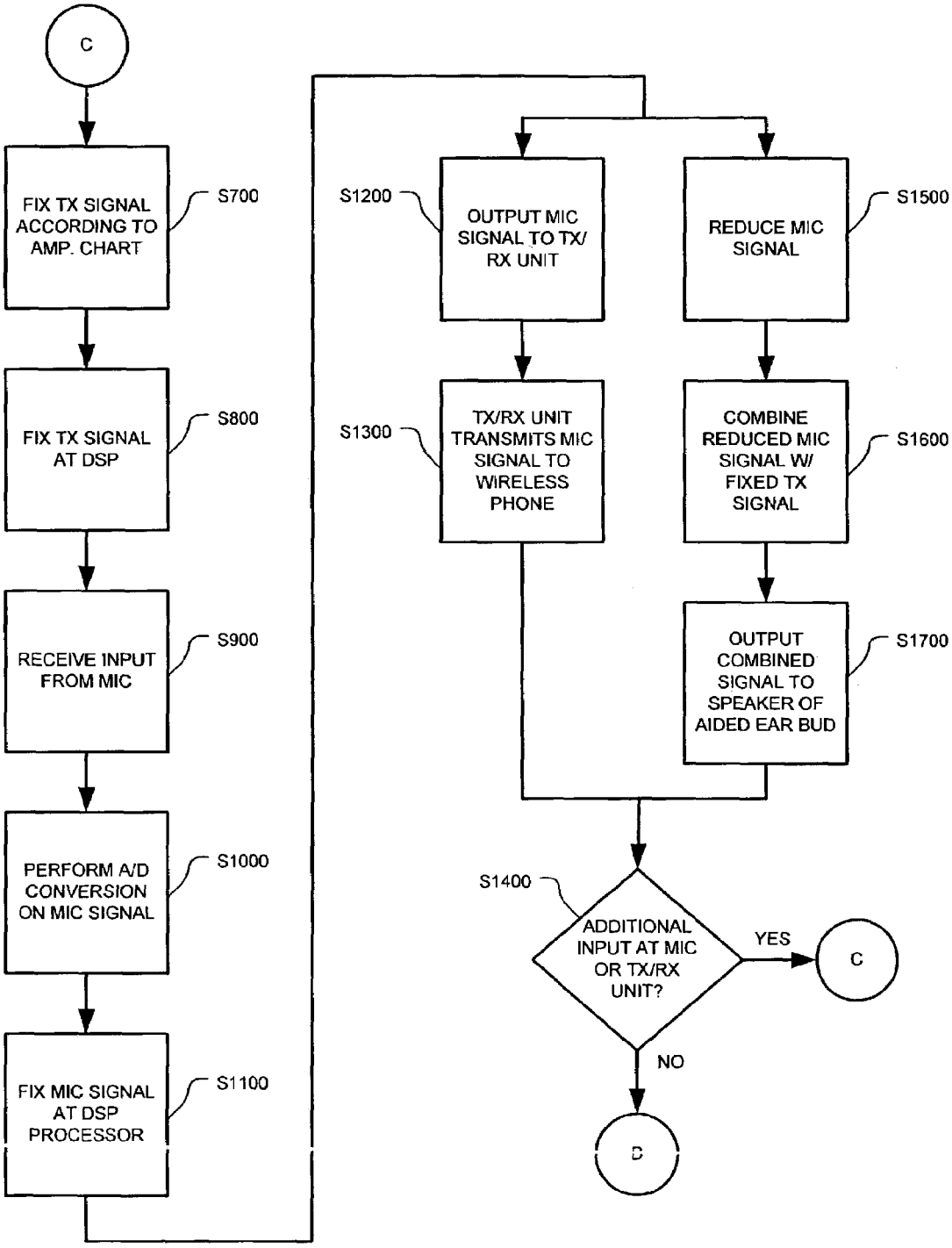

FIGS. 7 and 8 illustrate a flowchart outlining an exemplary method of receiving incoming calls using an aided ear bud according to this invention. As shown in FIG. 7, operation of the method begins at step S100, and continues to step S200, where the aided ear bud enters the hearing aid mode of operation. Then in step S300, the aided ear bud enters a monitoring loop to determine when an input is received at the microphone of the aided ear bud. If no input is received at the microphone, the aided ear bud continues to monitor the microphone for input. Otherwise, the process continues to step S400.

At step S400, the aided ear bud determines if a signal has been received at the TX/RX unit and verifies that the signal is from a valid source. Based on this determination, a signal can be generated that causes the aided ear bud to change to switch to an ear bud mode of operation. If the signal to change to the ear bud mode of operation is generated, the process continues to step S500. Otherwise, the process jumps to step S1800.

At step S1800, the aided ear bud retrieves the input from the microphone and continues to step S1900. At step S1900 the retrieved signal is converted from an analog signal to a digital signal. The process then continues to step S2000.

At step S2000, the digital signal is sent to the DSP to be processed. The process then continues to step S2100, where the corrected signal is output to the speaker of the ear bud. The speaker of the ear bud is typically positioned in or in close proximity to the user's ear.

Finally, the process jumps back to step S300, where the aided ear bud again begins to monitor for input at the microphone.

In step S500, once the signal has been received to change the aided ear bud to the ear bud state, a digital switch is activated that allows transmitted signals received at the TX/RX unit to pass to the DSP. The process then proceeds to step S600.

At step S600, the aided ear bud retrieves the transmitted signal from the TX/RX unit and then proceeds to step S700. In step S700, the process fixes the transmitted signal according to signal stored in the amplification chart. Once the signal has been fixed and verified, the process proceeds to step S800, where this fixed signal is forwarded across the digital switch and fixed by the DSP. The process then continues to step S900.

At step S900, the signal input at the microphone, is retrieved and converted from an analog signal to a digital signal. The digital microphone signal is then transferred to and fixed by the DSP in step S1100.

The process then performs steps S1200-S1300 and steps S1500-S1700 simultaneously. In steps S1200-S1300, the digital microphone signal is output to the TX/RX unit and then transmitted to the wireless phone. This method allows the users voice signal to be transmitted to the wireless phone as if they were speaking directly into the handset.

In steps S1500-S1700, the volume of the microphone signal is reduced, combined with the fixed signal from the TX/RX unit (step S900) and output to the speaker of the ear bud. Using this method, the sounds heard by the user encompass a reduced representation of their voice, which provides feedback of speaking volume, etc. and the signal coming directly from the wireless phone. Once both set of steps S1200-S1300 and steps S1500-S1700 are completed, the process proceeds to step S1400.

At step S1400, the aided ear bud checks the microphone and the TX/RX unit to see if there is any additional input from those sources. If additional signals are available, the process jumps back to sep S700. Otherwise, the ear bud returns to step S300 where the ear bud monitors for additional input at the microphone. The process then repeats itself as discussed above.

While this invention has been described in conjunction with the exemplary embodiments outlined above, it is evident that many alternatives, modifications and variations will be apparent to those skilled in the art. Accordingly, the exemplary embodiments of the invention, as set forth above are intended to be illustrative, not limiting. Various changes may be made without departing from the spirit and the scope of the invention.

What is claimed is:

1. A method for operation of a hearing aid device adapted to interface with a mobile device comprising the steps of:

receiving a switching command at an input of a hearing aid device;

switching to a second operating mode from a first operating mode in response to said switching command;

wherein said second operating mode further comprises the steps of said hearing aid device:

receiving a call audio signal at said hearing aid device;

said call audio signal being transmitted by a mobile device and representing audible content of a call;

outputting audio corresponding to said call audio signal on a speaker of said hearing aid device;

transmitting a microphone signal from said hearing aid device to said mobile device, said microphone signal corresponding to an audible sound received by said microphone of said hearing aid device; and mixing said call audio signal with said microphone signal to create a mixed signal.

2. A method of claim 1 wherein said switching command is received from a mobile telephone.

3. A method of claim 2, wherein said switching command is transmitted by said mobile telephone upon said mobile telephone being activated to answer an incoming call.

4. The method of claim 2, wherein said switching command is transmitted by said mobile telephone upon said mobile telephone being activated to initiate an outgoing call.

5. The method of claim 2, wherein said switching command is transmitted by said mobile telephone upon said mobile telephone receiving an incoming audio signal from an active call.

6. The method of claim 1, wherein said switching command is verified.

7. The method of claim 1, wherein said call audio signal is fixed according to desired characteristics prior to mixing with an ambient noise.

8. The method of claim 1, wherein the step of outputting audio corresponding to said call audio signal on said speaker of said hearing aid device comprises outputting said mixed signal on said speaker of said hearing aid device.

9. The method claim of 1, wherein the mixing step comprises:

reducing the amplitude of said microphone signal; and combining said reduced amplitude microphone signal with said call audio signal.

10. The method of claim 1, wherein the mixing step further comprises modifying said mixed signal based on values of an amplification chart.

11. The method of claim 1 wherein the mixing step further comprises modifying said mixed signal based on characteristics of said speaker of said hearing aid device.

12. The method of claim 1 wherein the mixing step further comprises modifying said mixed signal based on an ambient noise level surrounding said hearing aid device.

13. The method of claim 1 wherein the mixing step further comprises modifying said mixed signal to compensate for frequency dependent hearing loss of a user of said hearing aid device.

14. The method of claim 1 wherein the mixing step further comprises modifying said mixed signal based on characteristics of a user of said hearing aid device.

* * * * *